United States Patent [19]

Montgomery

[11] Patent Number: 4,804,098

[45] Date of Patent: Feb. 14, 1989

[54] DISPENSING CLOSURE

[75] Inventor: Gary V. Montgomery, Evansville, Ind.

[73] Assignee: Sunbeam Plastics Corporation, Evansville, Ind.

[21] Appl. No.: 164,848

[22] Filed: Mar. 3, 1988

[51] Int. Cl.[4] ..... B65D 41/04

[52] U.S. Cl. ..... 215/238; 215/245; 222/545; 222/558

[58] Field of Search ..... 215/238, 244, 245, 222, 215/311, 313, 223; 220/254; 222/545, 558

[56] References Cited

U.S. PATENT DOCUMENTS

| | | | |
|---|---|---|---|
| 319,500 | 6/1885 | McArdle | 215/238 |
| 779,678 | 1/1905 | Wandell | 215/260 X |
| 922,167 | 5/1909 | Leinbrock | 215/238 |
| 1,564,099 | 12/1925 | Morton | 215/238 |
| 2,080,201 | 5/1937 | Donadon et al. | 215/244 |
| 3,369,720 | 2/1968 | Libit et al. | 222/558 X |
| 3,809,300 | 5/1974 | Russell | 222/545 |
| 4,458,818 | 7/1984 | Hansen | 215/245 X |

FOREIGN PATENT DOCUMENTS

| | | | |
|---|---|---|---|
| 539320 | 2/1956 | Italy | 222/558 |

*Primary Examiner*—Donald F. Norton

*Attorney, Agent, or Firm*—Irvin L. Groh; Alfred L. Patmore, Jr.

[57] ABSTRACT

A dispensing closure in which the conventional lid is replaced by a U-shaped yoke with a sealing plug extending downwardly at the bight of the yoke. A self-returning force is generated by the removal of the closure plug from the dispensing orifice.

7 Claims, 3 Drawing Sheets

DISPENSING CLOSURE

This invention relates to a dispensing closure, and, more particularly, to a liquid dispensing closure having a tethered self-seating closure plug.

Typically, a dispensing closure differs from other closures in that other closures have a single piece such as a cap which is removed from a container to gain access thereto whereas a dispensing closure has two pieces which can be characterized as a base cap and a lid. The base cap is normally permanently retained on the container during initial packaging, and the contents of the container are dispensed through an orifice in the base cap. A lid is hinged to the base cap to move between a closed position covering the dispensing orifice and an open position for dispensing through the base cap orifice. In most cases the lid seals the orifice by contact around the perimeter thereof or typically, the orifice has an upstanding nozzle to direct the contents of the container as it is being dispensed and the lid coacts with the exterior or interior of the nozzle to provide a seal. While the user has no difficulty in breaking the seal by swinging the lid to an open position, there is no tendency for the lid to return to a sealed position when an initial closing movement is applied to the lid.

The hinge serves to orient the sealing portion of the lid relative to the base cap dispensing orifice, but there is no positive force created by the hinge to reinstitute the seal between the lid and cap or dispensing orifice. For example, a living hinge may be constructed with an over-the-center locking mechanism which holds the lid in an open dispensing position, but this locking mechanism does not supply a force tending to seal the dispensing orifice as the lid is swung to its closed position. With a strap type hinge, the orientation or alignment is even less positive than in an living hinge or a take-apart hinge, and resealing is often not effectuated even though the user may apply a perfunctuary closing motion to the lid.

It is a primary object or principle of this invention to provide positive alignment of a closure plug with a dispensing orifice in order to induce or more readily permit the user to reseal the dispensing orifice after use.

Even with the alignment provisions of this invention, a less than careful user can fail to exert the proper sealing force at the point in time and space where the closure plug is in alignment with the dispensing orifice. That is, the user can apply and remove the sealing force when the plug is not in alignment with the orifice and the plug has not commenced entry into the orifice.

It is another principle of this invention to provide a closure structure wherein the user can see when the closure plug is in alignment with the dispensing orifice thus providing visual feedback to assist the user in resealing the dispensing orifice.

It is still another principle of this invention to provide a self-returning or self-seating force between the closure plug and the base cap in order to effect sealing of the dispensing orifice by the plug when the two are in alignment or at least to provide "touch" feedback to the user indicating such alignment so that the user may exert the final sealing force.

The foregoing difficulties in the prior art structures have been overcome by incorporating the principles of the present invention in a dispensing closure which achieves the objects of the invention with the elimination of a conventional lid structure.

The dispensing closure of the present invention includes a base cap with an annular skirt portion having means for attachment to the neck of a container. This attachment means can include a bead projecting inwardly at the bottom of the cap skirt which coacts with a flange on the neck of the container so that the cap bead snaps over the container flange to retain the cap permanently or at least semi-permanently on the container. The base cap also has a closed top portion extending upwardly from the skirt with a centrally located orifice therein.

A closure plug is tethered to the base cap for sealingly engaging the dispensing orifice, and the plug is long enough to extend through the orifice to provide self-cleaning thereof in the closing and opening process. The tether attachment of the closure plug to the base cap is structured to limit the degree of movement of the plug so that it will come into alignment with the dispensing orifice during its movement to and through a closing manipulation. This is accomplished by the use of a U-shaped sealing yoke which has inwardly directed hinge pins at the free ends of its legs that engage recesses in the top portion of the base cap permitting swinging of the yoke over the top portion of the cap. The yoke has a handle portion which extends upwardly away from the legs at the bight of the yoke and a plug extending downwardly in the direction of the legs from the bight portion opposite the handle for sealingly engaging the dispensing orifice. The use of a pivoting yoke permits and provides for complete alignment of the closure plug with the dispensing orifice. This is not possible in the conventional lid design wherein the lid is hinged to the base cap at a point on the periphery of the two members so that a closure plug on the underside of the lid is swung in an arcuate path which does not permit complete alignment of the plug with the orifice when the plug makes contact with the top wall of the base cap defining the orifice or an upstanding nozzle extension thereof.

Means is provided to allow movement of the plug into the dispensing orifice and to allow release of the plug from the dispensing orifice by manipulation of the handle when the plug is in alignment with the dispensing orifice. In one embodiment this is accomplished by forming the recesses in the top portion of the base cap as slots so that the handle can be manipulated to move the hinge pins at the end of the yoke legs in the slots a sufficient distance for the plug to be released from the dispensing orifice. Preferably the slots are formed with cam surfaces against which the hinge pins are moved when the handle is manipulated so as to generate a self-returning or self-seating force as the hinge pins are moved in the slots releasing the plug from the dispensing orifice.

When the plug has been released from the dispensing orifice, the yoke can be swung downwardly over the top portion of the base into a dispensing position wherein it is clear of the orifice. When the yoke is swung in a closing direction, the plug will pass through a point in complete alignment with the dispensing orifice. This position of alignment can be observed by the open nature of the yoke structure as compared to the hidden position of a closure plug on the underside of a lid as it is being swung towards a closed position. Additionally, the self-seating or self-returning force generated during removal of the plug from the orifice pulls the plug into the orifice as the yoke is swung into position with the plug in alignment with the orifice.

Preferably the top portion of the base cap is rounded so that when the plug is released from the dispensing orifice, the plug will ride against the rounded portion as the yoke is swung downwardly into the dispensing position and the plug will also ride against the rounded portion when the yoke is swung in a closing position until the plug is in line with the orifice, at which point the plug will be drawn into the orifice by the self-returning force. The slot cam surfaces provide this preloading force. The rounded top portion can also be grooved to further guide the plug in its path between the sealing and dispensing positions.

The slots can be formed vertically in the top portion of the base cap so that the plug is released from the dispensing orifice by an upward movement of the handle. When the cam surfaces are provided, they diverge outwardly towards the top of the rounded top portion so that the self-returning force is generated as the plug is raised by movement of the handle.

In another embodiment where the slots are used to provide the necessary movement of the yoke and its attached plug, the slots can be sloped upwardly so that a twisting motion imparted to the handle will cause the hinge pins to rise in the slots causing the plug to be lifted vertically from the dispensing orifice. During the twisting movement, the plug turns as an axle in the dispensing orifice which acts as a journal and the yoke turns relative to the base cap. When the sloped slots are formed with cam surfaces which diverge outwardly as the slots approach the top of the top portion, a self returning force is generated.

In still another embodiment using slots to allow the hinge pins to move therein in order to raise the yoke and lift the plug out of engagement with the dispensing orifice, the slots can be L-shaped with the shorter leg of the L being adjacent to the cap skirt and the longer leg extending vertically upward on the rounded top portion. The plug is then release from the dispensing orifice by twisting the handle to move the hinge pins in the shorter legs of the L-shaped slots so that they are in line with the longer vertical legs and then the handle is moved upwardly to move the plug clear from the dispensing orifice. This adds a child resistant feature to the closure since two sequential motions are necessary to open the dispensing orifice. Like the two previous slot embodiments, the slots can be provided with cam surfaces. Here they would be provided in the longer vertical legs of the slots diverging outwardly towards the top of the rounded top. Again, the hinge pins would move along the cam surface when the handle is moved upwardly to generate the self-returning force as the plug is released from the dispensing orifice. Preferably the top surface is rounded so that the hinge pins move against the rounded surface as the yoke is swung downwardly into dispensing position and will ride against the rounded surface when the yoke is swung in a closing position until the plug is in line with the orifice and the plug is drawn thereinto by the self-returning force.

In another embodiment, the top is rounded and the sealing yoke is molded with a pliable plastic having a memory. The legs are molded with a sufficient curvature around the rounded top portion of the base cap so that the handle can be grasped and pulled upwardly to stretch or straighten the legs to release the plug from the dispening orifice. Again the yoke would be swung downwardly in contact with the rounded top portion to a dispensing position and swung upwardly to a closing position with the plug in line with the dispensing orifice and the plug would seat therein by the self-returning force in the plastic created by the original straightening of the leg members.

In the preferred embodiments, wherein the closed top portion of the base cap is rounded, the rounded or curved surface can be additionally supplied with a groove in which the plug rides and is guided. The upward vertical movement of the plug out of the dispensing orifice may be limited to the entry of the plug into the groove to further assure alignment of the plug with the dispensing orifice in the closing position.

In the preferred embodiments the closure plug is made long enough so that it extends through the dispensing orifice into a cavaity in the base cap top position to provide self-cleaning of the dispensing orifice. This requires a corresponding vertical distance component of the slot structure in some embodiments or proper sizing of the legs in another embodiment to obtain full movement of the plug through the orifice.

The objects of this invention are accomplished and the principles illustrated by the embodiments disclosed in the following description and illustrated in the drawing in which:

FIGS. 1–5 illustrate the closure of this invention with a base cap containing a dispensing orifice and a sealing plug supported on a yoke in its operationing positions, particularly showing the details of a first embodiment employing vertical slots for movement of the yoke hinge pins therein and wherein:

FIG. 1 is a perspective view of the first embodiment showing the closure in its sealed position;

FIG. 2 is a perspective view similar to FIG. 1 showing the closure with the yoke lifted to an open position;

FIG. 3 is a perspective view showing the yoke pivoted to a dispensing position;

FIG. 4 is an elevational view showing the closure in its sealed position;

FIG. 5 is a cross sectional view taken along line 5—5 of FIG. 4 showing the closure in its initially open position;

FIGS. 6–9 show a second embodiment of the invention utilizing sloped slots for movement of the yoke hinge pins in which:

FIG. 6 is a perspective view showing the closure as it is being opened by twisting the yoke handle;

FIG. 7 is a perspective view showing the yoke rotated to a dispensing position;

FIG. 8 is an elevational view partially in section showing the yoke and closure plug in a sealed position and in an open position in phantom lines;

FIG. 9 is a partial cross sectional view along line 9—9 of FIG. 8 showing the cam configuration;

FIGS. 12–14 illustrate a fourth embodiment in which the hinge pins fixed for rotation and the opening movement of the closure plug is obtained by the stretch or flexing of the yoke leg members in which:

FIG. 12 is a perspective view showing the relative motions of this fourth embodiment;

FIG. 13 is an elevational view in section taken along line 13—13 in FIG. 12 showing the closure in its sealed position; and FIG. 14 is a sectional view similar to FIG. 13 showing the closure in its initially open position.

Figure 1:
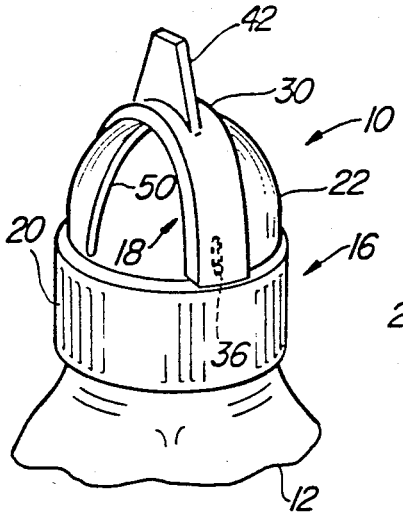

As seen in FIGS. 1–5 dispensing closure 10 is affixed to container 12 for dispensing a liquid product from the container through dispensing orifice 14. Closure 10 includes two pieces, a base cap 16 and a closing member 18. Base cap 16 has a annular skirt portion 20 and a rounded top portion 22. Skirt 20 has means for attachment to the container which can take the form illustrated in FIG. 5 of an inwardly directed bead 24 which coacts with flange 26 on neck 28 of container 12. This type of snap bead attachment permanently or at least semi-permanently connects the base cap to the container so that dispensing must take place through orifice 14.

Closing member 18 takes the form of a U-shaped sealing yoke having a central bight section 30 and depending legs 32. Hinge pins 34 are located adjacent to or at the free ends of legs 32 for cooperation with recesses 36 located at the bottom of top portion 22. In the embodiment of FIGS. 1–5 recesses 36 take the form of slots which extend vertically upward from a point adjacent cap skirt 20.

Figure 4:
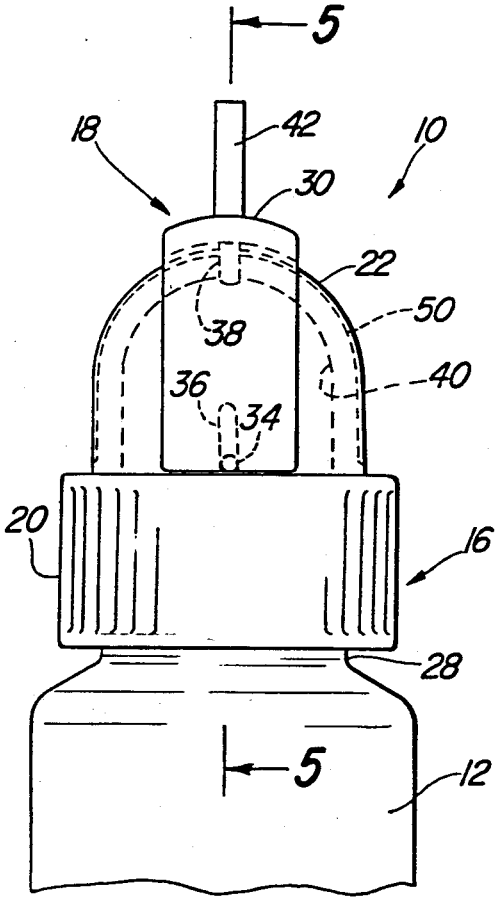

Closure plug 38 extends downwardly from bight 30 in the same direction as legs 32 for closing and sealing dispensing orifice 14. As best seen in FIG. 4, plug 38 is long enough to extend entirely through the wall 40 of rounded top portion 22. This makes the dispensing orifice 14 self-cleaning by the insertion and removal of the closure plug 38 therein.

Figure 2:
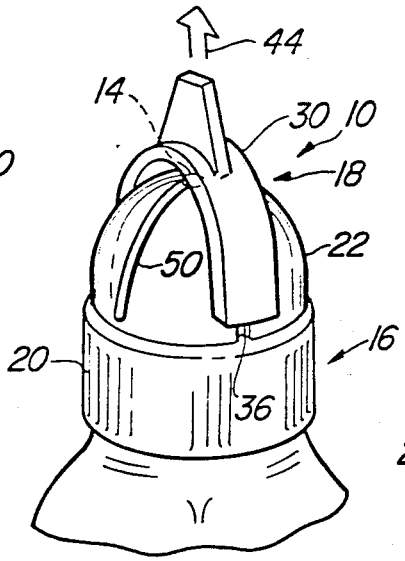
Figure 5:
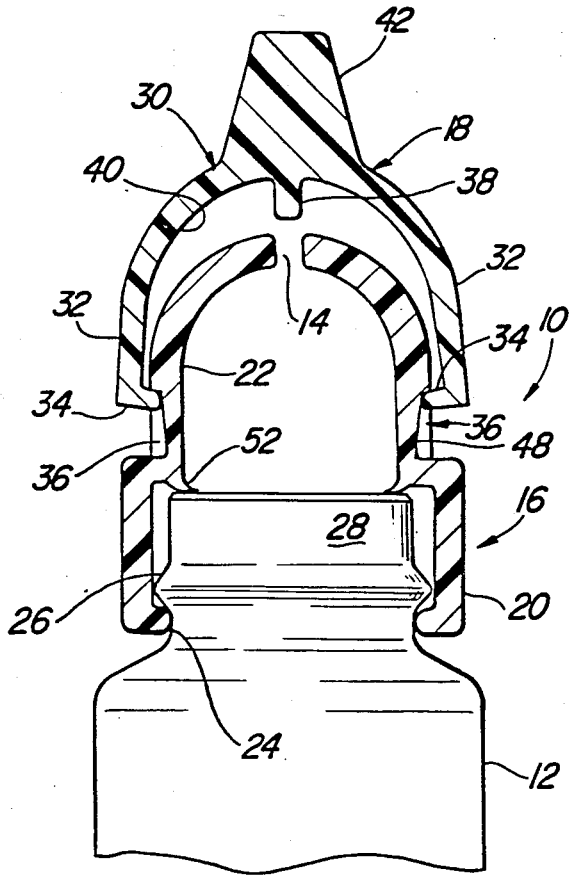

Handle 42 extends upwardly from bight portion 30 in a direction opposite to closure plug 38. Opening of dispensing orifice 14 takes place by an upward movement exerted on handle 42, as shown by arrow 44 in FIG. 2 which moves the hinge pins 34 in vertical slots 36 allowing the closure yoke 18 to be lifted so that closure plug 38 is released from dispensing orifice 14. FIGS. 1 and 4 show the closure in its closed or sealed position, and FIGS. 2 and 5 show the closure 10 in its open position. When the closure plug 38 is clear of the dispensing orifice 14 the yoke 18 can then be pivoted downwardly as shown by arrow 46 in FIG. 3.

Figure 3:
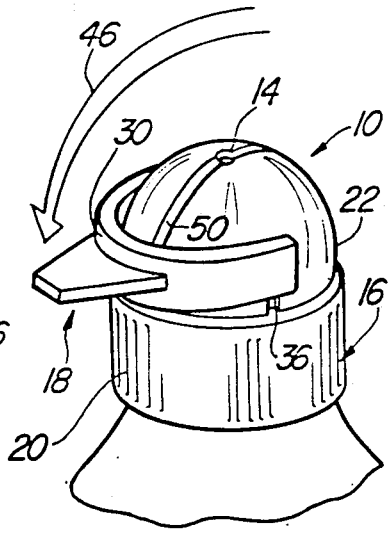

Preferably, vertical slots 36 are supplied with a cam surface 48 which diverges outwardly at an angle of 15°–20° from the vertical towards the top of top portion 22. As the hinge pins 34 ride against the cam surface 36 when the handle 42 is being raised, yoke legs 32 are elastically spread outwardly to generate a self-returning or self-closing force which will return the closure plug 38 into dispensing orifice 14 when the two are in alignment, and the upward force is removed on handle 42. As the yoke 18 is swung from its raised position in FIG. 2 to a dispensing position in FIG. 3 in which it is clear of dispensing orifice 14, the plug 38 rides against the rounded or spherical surface 22 of base cap 16. It will be readily apparent that only that portion in the path of closure plug 38 needs to be rounded or spherical for coaction with the closure plug in the swinging or pivoting movement to and from the dispensing position. As shown in FIGS. 1–3 a groove 50 can be provided in the rounded top portion 22 extending downwardly from the dispensing orifice 14 for guiding the plug 38 in its movement between a dispensing position and a sealing position. If desired, the vertical extent of slots 36 can be limited so that the plug 38 will not be raised above top 22 as shown in FIG. 5 but will only raise to a position locating it in slot 50. Base cap 16 is sealed to container neck 28 during its initial application by suitable means such as sealing fin 52 which coacts with the lip of the container neck 28.

Figure 6:
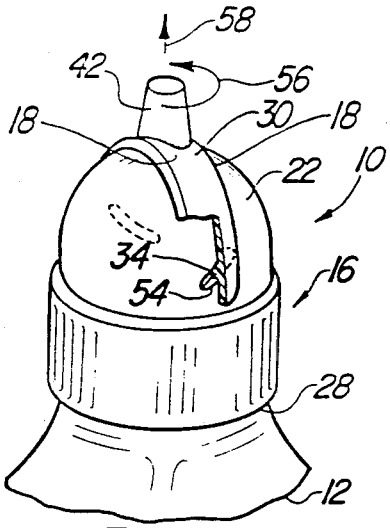
Figure 7:
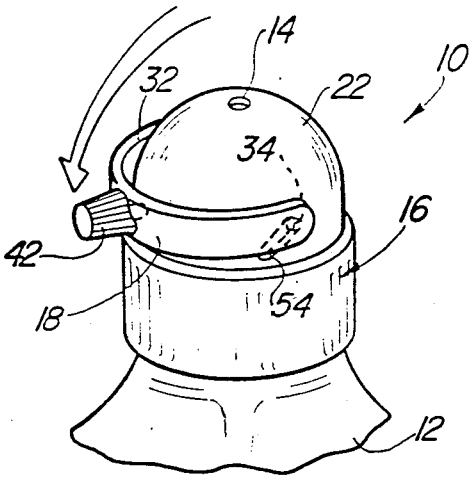
Figure 8:
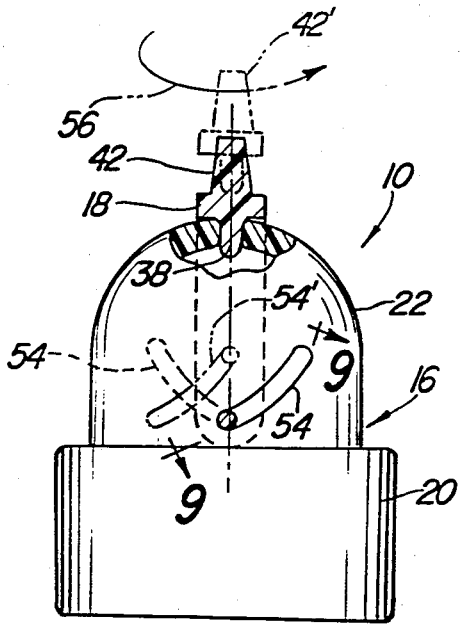
Figure 9:
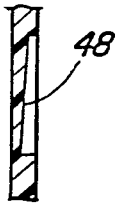

In the embodiments of FIGS. 6–9, the recesses into which the hinge pins 34 extend take the form of slots 54 which slope upwardly as best seen in FIG. 8. When handle 42 is twisted in a counterclockwise direction as shown by arrow 56 in FIGS. 6 and 8 hinge pins 34 will ride upwardly in these slots 54 causing the yoke 18 to rise as shown by arrow 58 in FIG. 6. FIG. 6 shows the hinge pin 34 in a partially elevated position in slot 54. FIG. 7 shows the yoke 18 pivoted to a dispensing position by swinging in the direction of arrow 46, and FIG. 8 shows the yoke with the closure plug in the completely sealed position and in the raised position as shown by handle 42′ in phantom. Slot 54′ shown in phantom in FIG. 8 shows the position of the slot 54 after the handle 42 has been twisted to an open position moving the plug 38 like an axle in dispensing orifice 14. This relative rotational movement between the yoke and rounded top 22 is shown as if the closure were rotated and the yoke remained stationary. Sloped slot 54 has a cam surface 48 as shown in FIG. 9 similar to that shown in the first embodiment in FIG. 5 which slopes or diverges outwardly toward the top of top portion 22. This provides the same type of self-returning action to closure plug 38.

Figure 10:
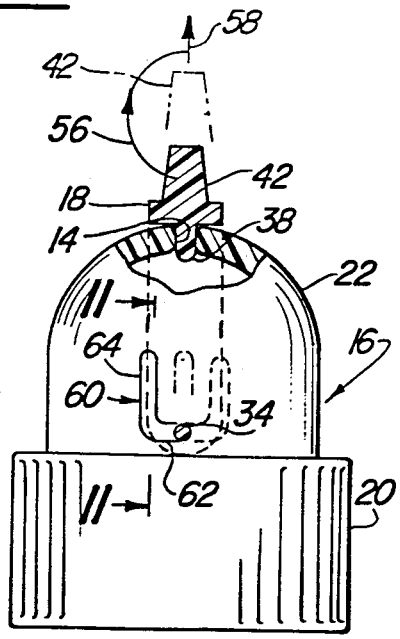
FIG. 10 is an elevational view partially in section similar to FIG. 8 showing a third embodiment employing L-shaped slots for movement of the yoke hinge pins.
Figure 11:
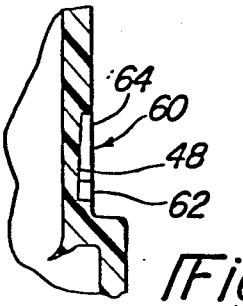
FIG. 11 is a partial sectional view along line 11—11 of FIG. 10 showing the cam surface of the third embodiment illustrated in FIG. 10.

In the embodiments of FIGS. 10 and 11 the recess in top portion 22 takes the form of an L-shaped slots 60 having a shorter leg portion 62 adjacent to the cap skirt 20 and a vertical leg 64. This provides a child-resistant feature requiring the handle 42 to be twisted in a clockwise direction, as shown by arrow 56 in FIG. 10, so that the hinge pins 34 move in the shorter leg 62 into alignment with the longer vertical leg 60 at which point an upward movement is exerted on the handle 42, as shown by arrow 58, causing the plug 38 to disengage from orifice 14. Outwardly diverging cam 48 is provided in the vertical leg 64 of L-shaped slot 62 to provide the self-returning force.

Figure 12:
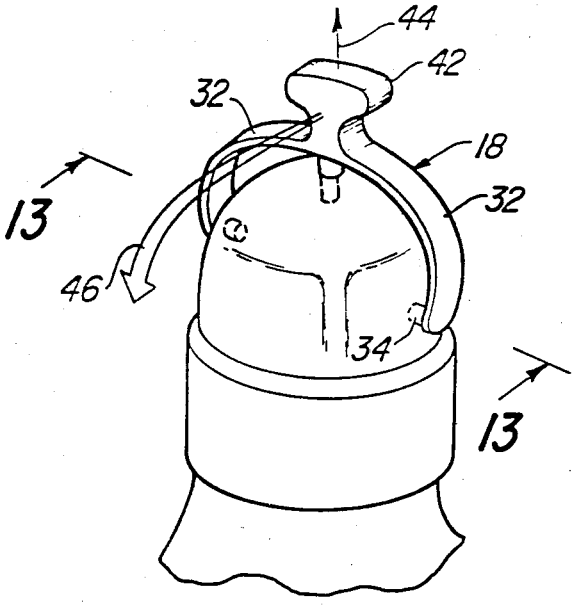
Figure 13:
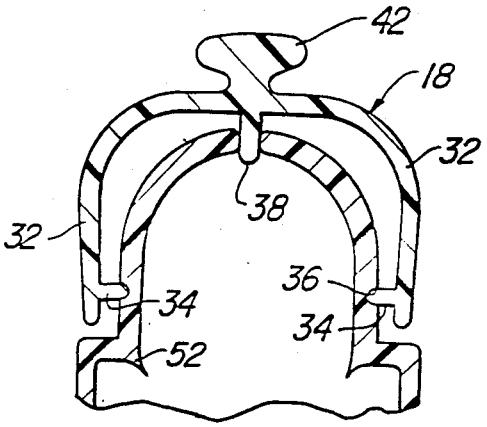
Figure 14:
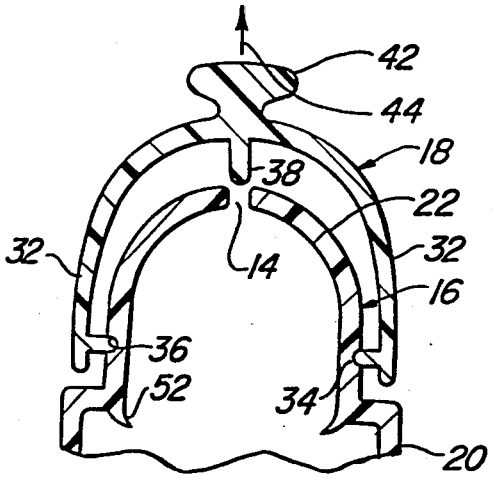

In the embodiment of FIGS. 12–14 the recesses 36 in top portion 22 are cylindrical so as to fix the hinge pins 34 in a stationary position for rotation of the yoke 18 as shown by arrow 46 in FIG. 12. Upward movement, as shown by arrow 58 in FIG. 10, to release closure plug 38 from dispensing orifice 14 is obtained by molding the yoke 18 with a resilient material and so shaping it that upward movement of the handle 42 straightens the yoke legs 32 from a position shown in FIGS. 12 and 13 where the closure plug 38 is in dispensing orifice 14 to an extended position shown in FIG. 14. The upward movement of and the closure plug 38 and stretch of the yoke legs 32 creates a self-returning force similar to that created by the cams 48 provided in the previous embodiments.

The embodiments of the invention in which an exclusive property or privilege is claimed are defined as follows:

1. A dispensing closure comprising, in combination:

a base cap having an annular skirt portion with means for attachment to the neck of a container and a rounded top portion extending upwardly from said skirt with a centrally located dispensing orifice therein;

a U-shaped sealing yoke having inwardly directed hinge pins at the free end of its legs engaging upwardly extending slots in the top portion of said base cap;

said yoke having a handle portion extending upwardly from said legs at the bight of said yoke and plug extending downwardly in the direction of said legs from the bight portion of said yoke for extending into and sealingly engaging said dispensing orifice;

said slots being formed with cam surfaces which diverge outwardly toward the top of said rounded top so that said handle can be manipulated to move said hinge pins in said slots a sufficient distance for said plug to be released by moving out of and clear of said dispensing orifice, and as said hinge pins are moved against said cam surfaces a self-returning force is generated;

whereby said yoke may be swung downwardly over said top portion of said base into a dispensing position and said plug will ride against said rounded portion as the yoke is swung downwardly into a dispensing position and will ride against said rounded portion when the yoke is swung in a closing direction until said plug is in line with said orifice and said plug is drawn therein by said self-returning force.

2. The dispensing closure according to claim 1 wherein said closure plug extends completely through said dispensing orifice when said plug sealingly engages said dispensing orifice to perform a self-cleaning function.

3. The dispensing closure according to claim 1 in which said attachment means includes a bead projecting inwardly at the bottom of said cap skirt which coacts with a flange on the neck of said container to permanently attach said closure to said container neck.

4. The dispensing closure according to claim 1 wherein said slots are vertical and said plug is released from said dispensing orifice by an upward movement of said handle.

5. The dispensing closure according to claim 1 wherein said slots are sloped upwardly and said plug is released from said dispensing orifice by twisting motion of said handle.

6. The dispensing closure of claim 1 wherein said slots are L-shaped with the shorter leg of the L being adjacent to said cap skirt and the longer leg extending vertically upward on said rounded top portion with said cam surface being formed therein, and said plug is released from said dispensing orifice by twisting said handle to move said hinge pins in the shorter legs of the L-shaped slots in line with the longer vertical legs and said handle is moved upwardly to move said hinge pins in said longer vertically extending legs against said cam surfaces moving said plug clear of said dispensing orifice.

7. The dispensing closure according to claim 1 further including a groove in said rounded top portion extending from said orifice downwardly toward said annular skirt portion so that said plug will ride in and be guided by said groove.

* * * * *